US006588678B1

(12) United States Patent
Mattes

(10) Patent No.: US 6,588,678 B1
(45) Date of Patent: Jul. 8, 2003

(54) INJECTION SYSTEM AND METHOD FOR OPERATING AN INJECTION SYSTEM

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/049,943

(22) PCT Filed: Aug. 10, 2000

(86) PCT No.: PCT/DE00/02680

§ 371 (c)(1),
(2), (4) Date: Jun. 12, 2002

(87) PCT Pub. No.: WO01/14734

PCT Pub. Date: Mar. 1, 2001

(30) Foreign Application Priority Data

Aug. 20, 1999 (DE) ..... 199 39 520

(51) Int. Cl.[7] ..... B05B 3/04

(52) U.S. Cl. ..... 239/102.2; 239/585.1; 239/533.7; 239/584; 251/57

(58) Field of Search ..... 239/102.1, 102.2, 239/533.7, 585.1–585.5, 583, 584; 251/57, 129.19, 129.06; 123/472, 498

(56) References Cited

U.S. PATENT DOCUMENTS 4,995,587 A * 2/1991 Alexius ..... 251/129.06
5,697,554 A * 12/1997 Auwaerter et al. ..... 239/88
6,142,443 A * 11/2000 Potschin et al. ..... 251/57
6,224,032 B1 * 5/2001 Potschin et al. ..... 251/57
6,290,204 B1 * 9/2001 Kienzler et al. ..... 251/57
6,311,950 B1 * 11/2001 Kappel et al. ..... 251/129.06
6,371,438 B1 * 4/2002 Boecking ..... 251/57
6,427,968 B1 * 8/2002 Stoecklein ..... 251/57
6,454,239 B1 * 9/2002 Boecking ..... 251/129.06
6,457,699 B1 * 10/2002 Stoecklein ..... 251/129.06
6,460,779 B1 * 10/2002 Boecking ..... 239/102.2

FOREIGN PATENT DOCUMENTS

EP 0 816 670 A1 * 7/1998 ..... F02M/47/02

* cited by examiner

*Primary Examiner*—David J. Walczak
*Assistant Examiner*—Amanda Flynn
(74) *Attorney, Agent, or Firm*—Ronald E. Greigg

(57) ABSTRACT

The invention relates to an injection system having a piezoelectric adjuster (10), a hydraulic booster (12) and a control valve (14). In continuous operation of the injection system, the stroke of the piezoelectric adjuster (10) can be transmitted to the control valve (14) via a hydraulic medium in the hydraulic booster (12). In addition, the piezoelectric adjuster (10) and the components of the hydraulic booster (12) are disposed relative to the control valve (14) such that at least a portion of the stroke of the piezoelectric adjuster (10) can be transmitted directly to the control valve (14). In the method according to the invention for operating a piezoelectric injector, in which the piezoelectric adjuster (10) is electrically excited and made to execute a stroke; in a first phase, the stroke is transmitted directly to a control valve (14); in a second phase, the stroke is transmitted hydraulically to a control valve (14); and the control valve (14) is opened by the stroke.

19 Claims, 3 Drawing Sheets

INJECTION SYSTEM AND METHOD FOR OPERATING AN INJECTION SYSTEM

CROSS-REFERENCE TO RELATED APPLICATIONS

This is a 35 U.S.C. 371 application of PCT/DE 00/02680, filed on Aug. 10, 2000.

BACKGROUND OF THE INVENTION

1. Field of the Invention

The invention relates to an injection system, having a piezoelectric adjuster, a hydraulic booster and a control valve, wherein in continuous operation of the injection system, the stroke of the piezoelectric adjuster can be transmitted to the control valve via a hydraulic medium in the hydraulic booster. The invention also relates to a method for operating an injection system.

2. Description of the Prior Art

An injection system, hereinafter also called a piezoelectric injector, as generically defined above, is used in particular in Diesel storage-type injection systems. In storage-type injection, also known as common rail injection, the pressure generation and the injection are decoupled from one another. The injection pressure of about 120 to 1600 bar is generated independently of the engine rpm and the injection quantity and is available in the rail—that is, the fuel reservoir—for the injection. The instant of injection and the injection quantity are calculated in the electronic control unit and converted by the injector at each engine cylinder. The object of the injector is to adjust the onset of injection and the injection quantity.

Besides triggering the injector via a piezoelectric element, triggering the injector via a magnet valve is also known.

While with magnet valves, adequately long valve strokes for use of the magnet valve as a control valve can be generated, controlling an injector with a piezoelectric element requires that additional measures be taken. This is because with a piezoelectric element, only a very tiny stroke can be generated, which is a fraction in the range of only thousandths of the length of the piezoelectric element. For actuation of the adjusting valve in continuous operation of the injector, this tiny stroke requires conversion. A hydraulic booster, for instance, is used for that purpose.

In FIG. 3, a control valve of the prior art for a piezoelectric adjuster is shown. The stroke of a piezoelectric element, not shown, is transmitted to a control valve 110 via a hydraulic booster. In this way, a valve stroke 112 is made available that suffices to move the control valve 110 back and forth between a first valve seat 114 and a second valve seat 116. The valve control chamber 118 is disposed below the control valve 110. This valve control chamber 118 is adjoined, via an inflow throttle 120, by a fuel inlet 122. On the other side, via an outflow throttle 124, the control chamber 118 communicates with the control valve 110. A thrust rod 126 reaches into the control chamber 118, and by way of this thrust rod the force for the injection nozzle, not shown, is transmitted.

The operating principle of the special piezoelectric injector, equipped with two valve seats 114, 116, in accordance with the prior art will now be explained in conjunction with FIG. 3. In the state shown, the control valve 110 is seated in the first valve seat 114. At this instant, via the fuel inlet 122, which communicates with the common rail, and the inflow throttle 120, a pressure can build up in the control chamber 118. If a voltage is now delivered to the piezoelectric element, not shown, the piezoelectric element generates a valve stroke, so that the control valve 110 assumes a middle position between the valve seat 114 and the valve seat 116. The pressure in the control chamber 118 is thus briefly reduced, so that the thrust rod, which is driven by a spring, not shown, in the direction of the control chamber can enter farther into the control chamber. An injection nozzle, not shown, is consequently briefly opened, in the present case for the sake of preinjection. As soon as the control valve 110 reaches the second valve seat 116, the high pressure made available by the common rail via the inflow throttle 120 can again build up in the control chamber 118. The thrust rod 126 is consequently forced out of the control chamber 118, and the injection nozzle closes. In the reverse motion of the control valve from the second valve seat 116 to the first valve seat 114, which follows an appropriate triggering of the piezoelectric element, a middle position is again assumed, which is however now utilized for the sake of the main injection.

The inflow throttle 120 and the outflow throttle 124 serve on the one hand, via their relative flow quantities, to determine the opening behavior of the nozzle needle. The outflow throttle 124 also serves to return a leakage quantity of fuel from the valve control chamber 118 into the hollow chamber located above it and, via the fuel return 128, to a fuel tank. The inflow throttle 120 prevents the pressure in the control chamber 118 from being immediately compensated for fully and adapting to the high pressure in the common rail, because only a pressure drop makes the opening of the nozzle needle possible, by retraction of the thrust rod 126.

In the present special case in the prior art shown in FIG. 3, a control valve 110 is shown with two valve seats 114, 116. However, the general principles of valve control can also be accomplished with only a single valve seat. For the same injection frequency, the piezoelectric element must then be excited with voltage pulses at twice the frequency, for instance.

A common feature of the systems in the prior art, one of which is shown in FIG. 3, is that both in the starting event and in operation, there must be a system pressure in the injector. This makes demands in terms of the capacity of the high-pressure pump of the common rail system, since the leakage quantity for assuring the supply of system pressure must be furnished by the high-pressure pump. Other disadvantages arise in conjunction with the incident leakage quantities, since these quantities must be removed from the system at high pressure. In addition, the systems in the prior art are dependent on environmental factors, since an engine turned off at high temperatures, for example, vaporizes the fuel out of the coupler chamber of the control valve, which makes additional demands of the pressure supply upon restarting of the system.

SUMMARY OF THE INVENTION

The injection system of the invention builds on the prior art in an advantageous way in that the piezoelectric adjuster and the components of the hydraulic booster are disposed relative to the control valve such that at least a portion of the stroke of the piezoelectric adjuster can be transmitted directly to the control valve. The control valve can thus open on the basis of the stroke of the piezoelectric element without there having already been a system pressure present. As soon as the control valve opens as a result of the direct action of the piezoelectric adjuster, the pressure present in the common rail fills the system region with fuel, and the piezoelectric injector is ready for the continuous operation.

The system can accordingly assure the supply of a system pressure at anytime, regardless of such environmental factors as high heat or a relatively long period in which the engine is not in operation. It is surprising that a direct or in other words nonhydraulic transmission of force from the piezoelectric element to the control valve is possible at different temperatures, since the piezoelectric element does change its length as a function of the temperature. In the systems of the prior art, this was not a fundamental problem because a force transmission took place only hydraulically in any case. Now, however, since the relative position between the piezoelectric element and the control valve is crucial, the temperature dependency of the length of the piezoelectric element appears to present a fundamental problem. Within the scope of the invention, however, it was discovered that the change in length of the piezoelectric element can be at least nearly compensated for precisely as a result of the change in the stroke capacity. This is due to the following facts. With regard to its longitudinal expansion, the piezoelectric element has a negative temperature coefficient. In other words, at high temperatures the piezoelectric element is shorter than at low temperatures. However, at high temperatures the stroke capacity of the piezoelectric element increases, which given a suitable choice of possible other peripheral parameters can lead to a compensation for the shortening in length. At low temperatures, virtually the entire stroke of the piezoelectric element could accordingly be converted into a stroke of the control valve, if the great length of the piezoelectric element means that a direct or nearly direct contact of the elements within the hydraulic booster exists. At a higher temperature, when the piezoelectric element has a shorter length, there will generally be a spacing between elements of the travel booster. However, since in this case the stroke capacity is greater, the stroke of the piezoelectric element will first run down to zero and beyond a certain instant will again directly subject the control valve to force and consequently open it.

Preferably, the hydraulic booster has a first booster piston, which can be subjected to force by a stop of the piezoelectric adjuster. In this way, a direct force transmission from the piezoelectric adjuster to the hydraulic booster takes place, which depending on the operating state can be transmitted hydraulically or directly to the control valve.

It is advantageous if the hydraulic booster has a second booster piston, which can be subjected to force by the first booster piston. In this advantageous embodiment, the invention consequently has a hydraulic booster with at least two booster pistons, which can interact both via a hydraulic medium and directly. The fundamental concept of the invention is thus realized in an elegant way.

Preferably, at least during the continuous operation, hydraulic medium is present between the first booster piston and the second booster piston. It is thus assured that the stroke of the piezoelectric adjuster is converted into an adequate stroke of the control valve by the mediation of the hydraulic booster. This stroke must be long enough that an adequate pressure drop is generated in the control chamber and the injection nozzle can open.

Preferably, in the direct transmission of the stroke of the piezoelectric adjuster to the control valve, there is direct contact between the first booster piston and the second booster piston. In contrast the continuous operation of the control valve, in which the adjusting force is transmitted via a hydraulic medium, in the direct force transmission a direct contact between the booster pistons of the hydraulic booster is utilized. This direct contact can be realized over a wide temperature range, since the particular temperature behavior of the piezoelectric element has direct effects on the relative positions of the booster pistons.

Preferably, in the direct transmission of the stroke of the piezoelectric adjuster to the control valve, the control valve opens to a lesser extent than in the case of the hydraulic transmission during continuous operation. A slight opening of the control valve in response to the direct force transmission is sufficient to assure filling of the system region with fuel. Consequently, after this filling, the prerequisite for hydraulic operation of the control valve exists.

It is especially preferred that in the direct transmission of the stroke of the piezoelectric adjuster to the control valve, the control valve uncovers a gap in the range of approximately 3 to 5 $\mu$m. Such a gap is sufficient to assure filling of the coupler chamber of the booster. On the other hand, sufficient throttling is made available to prevent unintended injection upon engine starting.

Preferably, a pressure holding valve is provided for establishing a desired system pressure. This valve is capable, after the filling of the system region with fuel, which can be effected within a few milliseconds, of establishing the desired system pressure.

The invention advantageously makes a method for operating an injection system having a piezoelectric adjuster, a hydraulic booster and a control valve available, in which the piezoelectric adjuster is electrically excited and made to execute a stroke; in a first phase, the stroke is transmitted directly to a control valve; in a second phase, the stroke is transmitted hydraulically to the control valve; and the control valve is opened by the stroke. The method thus usefully employs two fundamentally different principles for opening the control valve. Even when the coupler chamber is empty, that is, a coupler chamber in which there is no hydraulic medium, it is possible by the excitation of the piezoelectric adjuster to open the control valve of the piezoelectric injector by direct mechanical contact. Such direct mechanical contact can be realized over a wide temperature range because of the special temperature behavior of the piezoelectric element in view of the temperature coefficient and the temperature dependency of the stroke. By the opening of the control valve generated by direct mechanical contact, the system region can be filled with hydraulic medium, so that subsequently, in a second phase, a hydraulic force transmission can take place. By the hydraulic force transmission, a travel conversion is effected, so that the stroke of the piezoelectric adjuster is converted into a stroke that suffices to open the injection nozzle.

It is advantageous if in the first phase, the stroke opens the control valve to a lesser extent than in the second phase. Besides the fundamental differences already mentioned between the direct force transmission and the hydraulic force transmission, the slight opening of the control valve in the first phase can additionally assure that by suitable throttling of the control valve, an injection of fuel upon engine starting is prevented.

It is especially preferred that in the first phase, the stroke opens the control valve within the range of approximately 3 to 5 $\mu$m. This opening suffices for fast filling of the system region with fuel; at the same time, a useful throttling action is made available. Overall, the leakage quantity of the system is reduced compared to the use of a constant throttle, and this means an advantageously lower demand for capacity of the high-pressure pump.

The method of the invention is especially advantageous if the first phase is a starting phase and the second phase is a phase of continuous operation. With a hot engine and a high ambient temperature, evaporation of the hydraulic medium from the hydraulic booster can occur. If the vehicle is then to be restarted, conventional systems require that hydraulic medium be furnished by means of an increased capacity of the high-pressure pump. However, if it is possible in the starting phase to transmit the stroke of the piezoelectric adjuster directly to the control valve, then the result achieved is an integrated supply of system pressure, and the system is prepared for the hydraulic long-term operation.

Preferably, immediately following the starting phase, a system pressure is established by a pressure holding valve. In this way, the advantages of the common rail system, in which the pressure generation and the injection are decoupled from one another, can be utilized in conjunction with the invention.

The invention is based on the surprising finding that by utilizing the temperature behavior of a piezoelectric element, an integrated system supply can be achieved. Each time the system is started, the system pressure region is filled, so that environmental factors such as the temperature are prevented from affecting the starting behavior. At the same time, the incident leakage quantity is reduced markedly compared to a control valve with a constant throttle, and thus the high-pressure pump of the common rail system needs less capacity. Because of the possibility of pressureless dissipation of the leakage quantity in the injector, it is possible to use conventional leakage hoses.

BRIEF DESCRIPTION OF THE DRAWINGS

The invention will now be described in terms of preferred exemplary embodiments in conjunction with the drawings, in which;

FIG. 1 is a highly schematic sectional view through a device according to the invention.

DESCRIPTION OF THE PREFERRED EMBODIMENTS

Figures 1A, 1B:
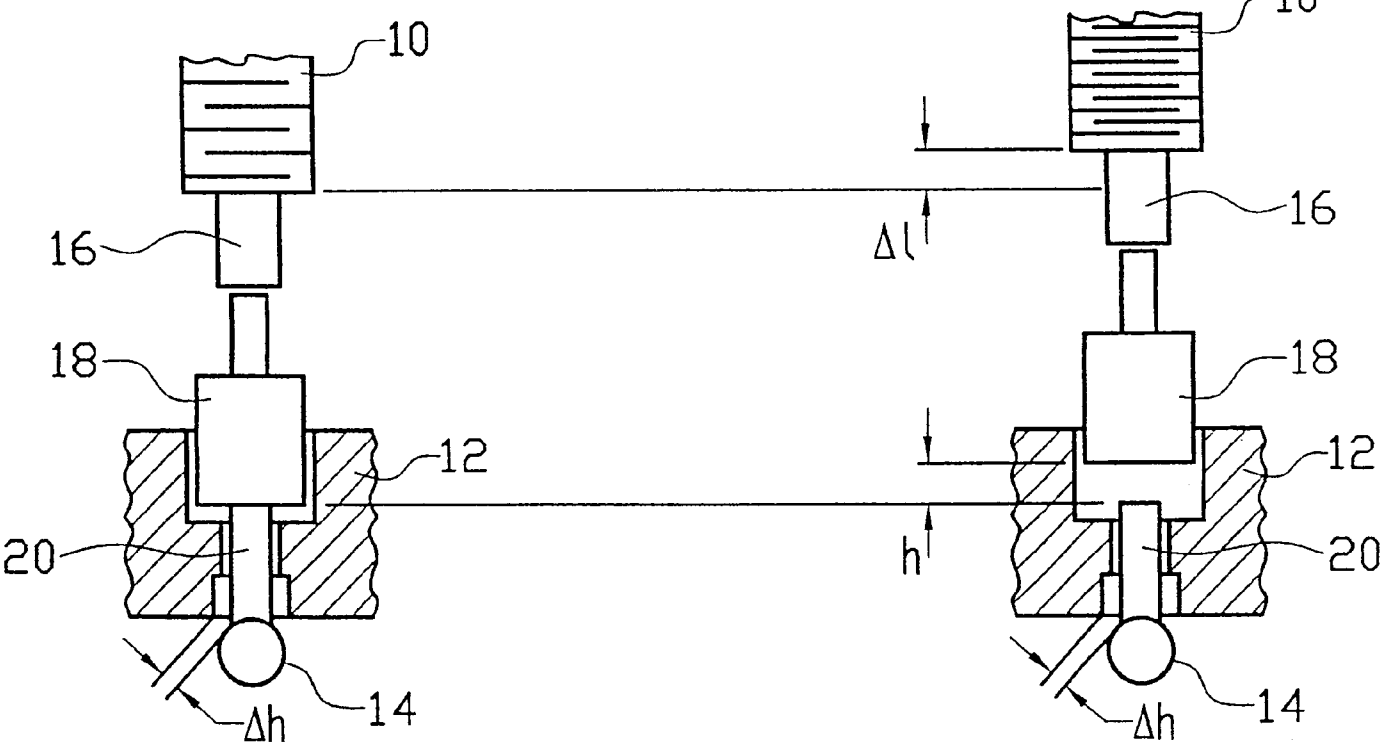
FIG. 1*a* shows a first operating state.
FIG. 1*b* shows a second operating state.

FIG. 1*a* shows a detail of a piezoelectric injector with a piezoelectric adjuster 10, a hydraulic booster 12 and a control valve 14. On the piezoelectric adjuster 10, a stop 16 is provided, which subjects a first booster piston 18 to force upon an actuation of the piezoelectric adjuster 10. The first booster piston 18 interacts with a second booster piston 20, so that as a result the control valve 14 can be opened.

FIG. 1*a* shows a state at low temperature, for instance −40° C. Consequently the piezoelectric adjuster 10 has a comparatively great length, since the piezoelectric element has a negative temperature coefficient. Because of this great length of the piezoelectric adjuster 10, the first booster piston 18 is in direct mechanical contact with the second booster piston 20. The stroke of the piezoelectric adjuster 10 is thus transmitted directly, that is, without hydraulic travel boosting, to the control valve 14. It is indicated in the drawing that the control valve 14 is opened by an amount Δh.

FIG. 1*a* shows a different state of the device of the invention, in which the same elements are identified by identical reference numerals. For the sake of greater simplicity, the control valve 14 is shown in the same state as in FIG. 1*a*. Between the first booster piston 18 and the second booster piston 20 of the hydraulic booster 12, there is a free space that results from the difference in length Δl of the piezoelectric adjuster 10 of FIG. 1*b* in comparison to FIG. 1*a*. This difference in length Δl is due to the fact that in FIG. 1*b*, a state is shown at a higher temperature, for instance at 120° C., than in FIG. 1*a*. The aforementioned negative temperature coefficient of the piezoelectric element consequently leads to the retraction of the first booster piston 18. However, the stroke capacity of the piezoelectric adjuster 10 is greater at the high temperature than at the low temperature. If accordingly there is no hydraulic medium in the interstice between the first booster piston 18 and the second booster piston 20, then by actuation of the piezoelectric adjuster 10 the interstice between the booster pistons 18, 20 can first be overcome and then the control valve 14 can be moved out of the valve seat by the amount Δh. As already noted, FIG. 1*b* is highly schematic, for the sake of easier comparison with FIG. 1*a*. In actuality, before a system start, the control valve 14 would be seated in its valve seat and would not open until after actuation of the piezoelectric adjuster 10. In addition, the two pistons 18, 20 would be in contact, but the pistons 16, 18 would be separated by the stroke h. On the other hand, it is also conceivable to prestress the piston 18 counter to the piston 16 by means of a spring.

Figure 2:
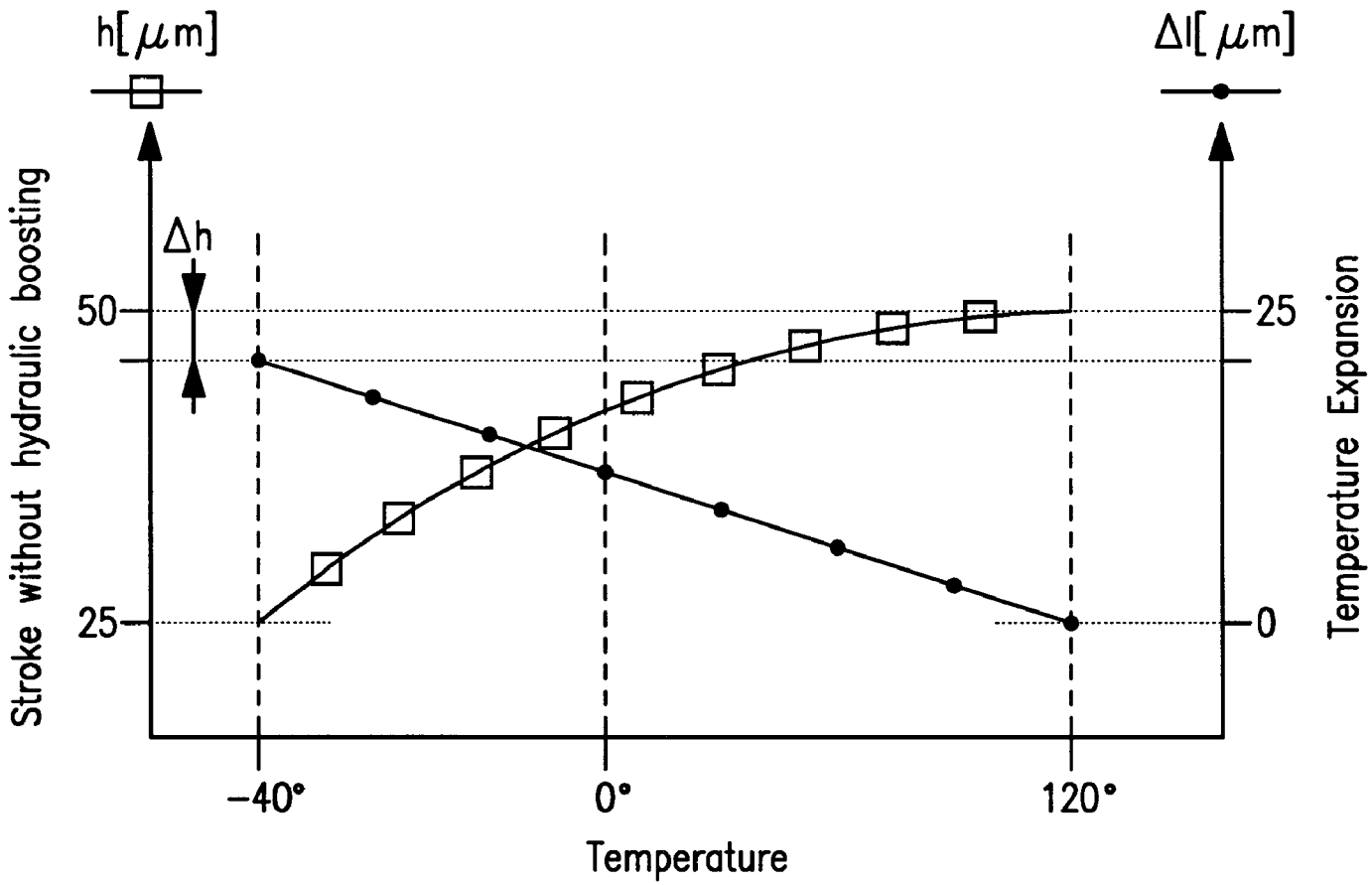
FIG. 2 is a graph explaining the properties of a piezoelectric element.

The interaction between the change in length and the stroke capacity of the piezoelectric adjuster can be better seen from FIG. 2. In the graph of FIG. 2, the stroke of the piezoelectric adjuster without hydraulic boosting is plotted on the left-hand vertical axis. The change in length Δl, or the temperature expansion, of the piezoelectric adjuster is plotted on the right-hand vertical axis. Both the stroke h and the change in length Δl are shown as a function of the temperature, which is plotted on the horizontal axis. The curve that connects the blank squares pertains to the stroke of the piezoelectric adjuster 10. The curve that connects the dots pertains to the change in length Δl. The change in length Δl has its reference point at the high temperature of 120° C., so that at that point it is defined as Δl=0. The graph shows that at the temperature of −40° C., the piezoelectric adjuster has expanded by an amount that for instance is slightly less than 25 μm. At this temperature value of −40° C., the stroke capacity of the piezoelectric adjuster is approximately 25 μm, compared to approximately 50 μm at 120° C. Because of the aforementioned change in length Δl at the low temperature of −40° C., however, the reduced stroke capacity is still sufficient to lift the control valve 14 out of the valve seat by a sufficient amount Δh. At a high temperature, when Δl=0, the increased stroke capacity of approximately 50 μm provides for a sufficient opening of the control valve 14.

Figure 3:
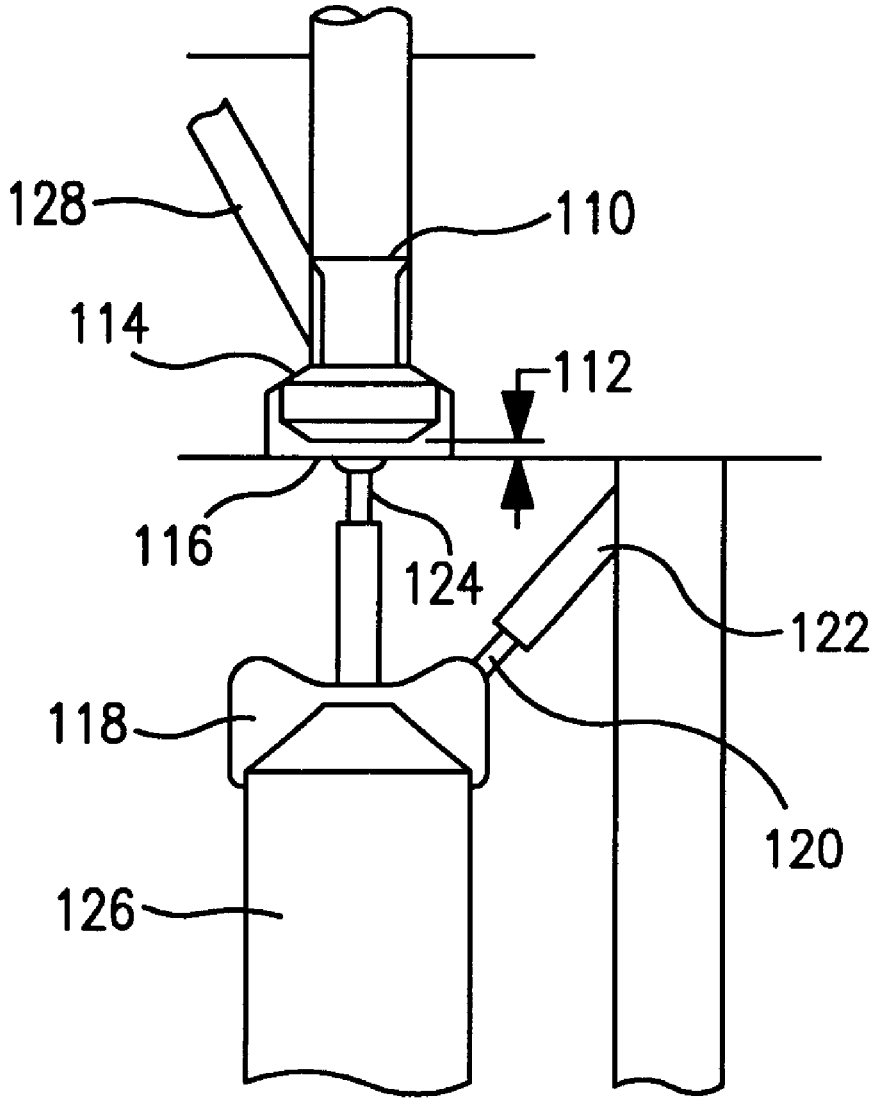
FIG. 3 PRIOR ART
FIG. 3 shows a device according to the prior art.

The graph in FIG. 2 shows the interaction between the stroke h and the temperature expansion Δl only schematically. In actuality, the changes in length Δl and the stroke h must also be finely tuned to one another. Care must be taken to assure that in direct force transmission, the opening Δh of the control valve 14 is always great enough to enable fast filling of the system with fuel. On the other hand, the opening Δh must not be too great, either, so that the control valve 14 advantageously has a throttling action. This throttling action should be adapted as needed to the throttling action of an inflow throttle (see FIG. 3 pertaining to the prior art).

The above description of the exemplary embodiments of the present invention is intended solely for illustrative purposes and not for the sake of limiting the invention. Within the scope of the invention, various changes and modifications are possible without departing from the scope of the invention or its equivalents.

What is claimed is:

1. An injection system, having a piezoelectric adjuster (10), a hydraulic booster (12) and a control valve (14), wherein in continuous operation of the injection system, the stroke of the piezoelectric adjuster (10) can be transmitted to the control valve (14) via a hydraulic medium in the hydraulic booster (12), and wherein, until the buildup of a system pressure in the hydraulic booster (12), at least a portion of the stroke of the piezoelectric adjuster (10) is transmitted directly to the control valve (14) by the components of the hydraulic booster.

2. The injection system of claim 1 wherein the hydraulic booster (12) has a first booster piston (18), which can be subjected to force by a stop (16) of the piezoelectric adjuster (10).

3. The injection system of claim 2 wherein, in the direct transmission of the stroke of the piezoelectric adjuster (10) to the control valve (14), the control valve opens to a lesser extent than in the case of the hydraulic transmission during continuous operation.

4. The injection system of claim 2 wherein the hydraulic booster (12) has a second booster piston (20), which can be subjected to force by the first booster piston (18).

5. The injection system of claim 4 wherein, in the direct transmission of the stroke of the piezoelectric adjuster (10) to the control valve (14), the control valve opens to a lesser extent than in the case of the hydraulic transmission during continuous operation.

6. The injection system of claim 4 where in the direct transmission of the stroke of the piezoelectric adjuster (10) to the control valve (14), there is direct contact between the first booster piston (18) and the second booster piston (20).

7. The injection system of claim 6 wherein, in the direct transmission of the stroke of the piezoelectric adjuster (10) to the control valve (14), the control valve opens to a lesser extent than in the case of the hydraulic transmission during continuous operation.

8. The injection system of claim 4 wherein, at least during the continuous operation, hydraulic medium is present between the first booster piston (18) and the second booster piston (20).

9. The injection system of claim 8 wherein, in the direct transmission of the stroke of the piezoelectric adjuster (10) to the control valve (14), the control valve opens to a lesser extent than in the case of the hydraulic transmission during continuous operation.

10. The injection system of claim 8 where in the direct transmission of the stroke of the piezoelectric adjuster (10) to the control valve (14), there is direct contact between the first booster piston (18) and the second booster piston (20).

11. The injection system of claim 10 wherein, in the direct transmission of the stroke of the piezoelectric adjuster (10) to the control valve (14), the control valve opens to a lesser extent than in the case of the hydraulic transmission during continuous operation.

12. The injection system of claim 1, wherein, in the direct transmission of the stroke of the piezoelectric adjuster (10) to the control valve (14), the control valve opens to a lesser extent than in the case of the hydraulic transmission during continuous operation.

13. The injection system of claim 12 wherein, in the direct transmission of the stroke of the piezoelectric adjuster (10) to the control valve (14), the control valve uncovers a gap in the range of approximately 3 to 5 $\mu$m.

14. The injection system of claim 1 wherein a pressure holding valve is provided for establishing a desired system pressure.

15. A method for operating an injection system having a piezoelectric adjuster (10), a hydraulic booster (12) and a control valve (14), in which the piezoelectric adjuster (10) is electrically excited and made to execute a stroke, the method comprising transmitting the stroke of the piezoelectric adjuster by the hydraulic booster components at least in part directly to the control valve (14) until system pressure is built up in the hydraulic booster, and then opening the control valve (14) is opened by the stroke of the piezoelectric adjuster.

16. The method of claim 15 wherein in the first phase, the stroke opens the control valve (14) to a lesser extent than in the second phase.

17. The method of claim 16 wherein the first phase, the stroke opens the control valve within the range of approximately 3 to 5 $\mu$m.

18. The method of claim 15 wherein the first phase, the stroke opens the control valve within the range of approximately 3 to 5 $\mu$m.

19. The method of claim 15 wherein the first phase is a starting phase and the second phase is a phase of continuous operation.

* * * * *